United States Patent [19]

Strange

[11] 4,290,714

[45] Sep. 22, 1981

[54] MARINE OIL LEAK CONTAINMENT AND RECOVERY APPARATUS

[75] Inventor: Booth B. Strange, Houston, Tex.

[73] Assignee: Western Geophysical Co. of America, Houston, Tex.

[21] Appl. No.: 99,388

[22] Filed: Dec. 3, 1979

[51] Int. Cl.[3] ..... E02B 15/04

[52] U.S. Cl. ..... 405/60; 210/923

[58] Field of Search ..... 405/60, 63, 66; 210/242.5, 923, 925

[56] References Cited

U.S. PATENT DOCUMENTS

| | | | |
|---|---|---|---|
| 3,469,402 | 9/1969 | Lowd . | |
| 3,500,841 | 3/1970 | Logan . | |
| 3,548,605 | 12/1970 | Paull et al. . | |
| 3,599,434 | 8/1971 | Miraud . | |
| 3,599,590 | 8/1971 | Rego | 405/63 |
| 3,653,215 | 4/1972 | Crucet . | |
| 3,658,181 | 4/1972 | Blair . | |
| 3,666,100 | 5/1972 | Madej . | |
| 3,667,605 | 6/1972 | Ziedlinski . | |
| 3,674,150 | 7/1972 | Lejune | 210/923 X |
| 3,708,983 | 1/1973 | Brown et al. . | |
| 3,724,662 | 4/1973 | Ortiz | 210/923 X |
| 3,745,773 | 7/1973 | Cunningham . | |
| 3,779,020 | 12/1973 | Muramatsu et al. . | |
| 3,879,951 | 4/1975 | Mason . | |
| 3,979,291 | 9/1976 | In't Veld | 210/923 X |
| 4,047,390 | 9/1977 | Boyce . | |

FOREIGN PATENT DOCUMENTS

| | | | |
|---|---|---|---|
| 1239992 | 5/1967 | Fed. Rep. of Germany | 405/60 |
| 139527 | 12/1978 | Norway . | |
| 1544710 | 4/1979 | United Kingdom | 405/60 |

*Primary Examiner*—David H. Corbin

*Attorney, Agent, or Firm*—William A. Knox

[57] ABSTRACT

A barge has a well in the center. A rigid oil containment sleeve is lowered through the well by suitable winches and cables. The barge is towed over a source of leaking oil and is anchored in position. Leaking oil accumulates inside the oil containment sleeve. A plurality of standpipes, open at their upper end to the fluid in the well, are built into the hull of the barge. The standpipes provide a protected volume from which gas bubbles can escape. Pumps whose inlets are connected to the bottom of the standpipes pump the oil from the standpipe into an oil storage vessel. Gas that accompanies the oil is flared to prevent dissemination of the noxious gases. A sprinkling system cools the barge deck from the heat of the flared gas.

16 Claims, 9 Drawing Figures

2
8
10
12
14
16
18
20
22
23
24
25
26
28
30
32
34
36
38
40
41
42
43
44
46
48

10
12
13
14
32
33
34
36
38
44
45
46
50
52
54
55
56
57
58
60
62
64
66
68
70
72
74
76
77
78
79
80
82
84
86
88
90
92
94
96
101
103
105
107
109
P
V

Fig. 5
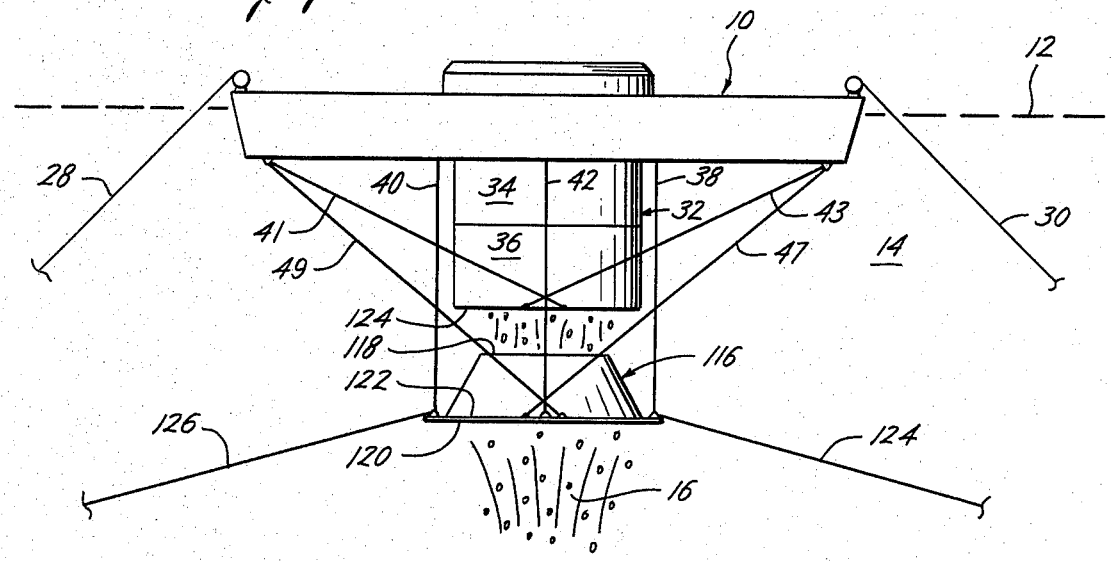
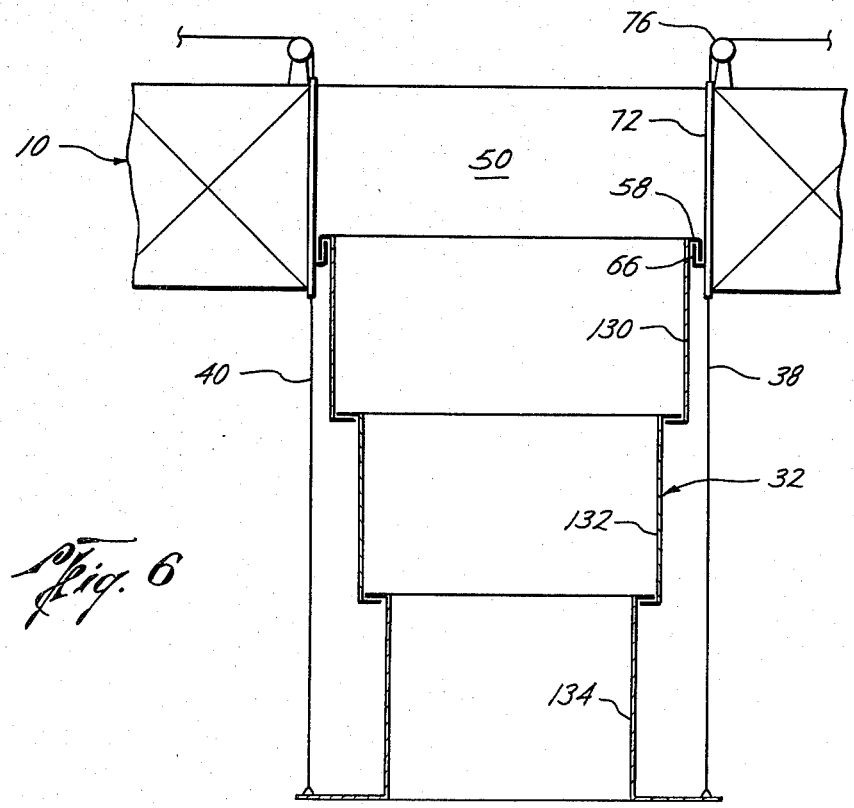
Fig. 6

MARINE OIL LEAK CONTAINMENT AND RECOVERY APPARATUS

BACKGROUND OF THE INVENTION

1. Field of the Invention

This invention relates to an environmental protective device for containing and recovering the effluent from a submarine oil leak at the source.

2. Description of the Prior Art

During the drilling and completion of offshore oil wells, a severe leak or so-called blowout occasionally occurs. As a result, huge quantities of oil and gas escape into the water and rise to the surface. Under action of wind and current the resulting oil slick may wash onto and contaminate beaches, fisheries and the like. Until the oil leak is brought under control, it is desirable to contain the leaking oil in situ.

Oil and gas issuing from the underwater leak is often under considerable pressure. Accordingly, the combined fluids escape as a jet. The jet action generates vortices in the water, forming a gas-saturated oil-water mixture. On reaching the surface, the gas separates from the oil-water mixture and often is ignited by a stray spark, creating a huge flare. If the oil leak issues from a ruptured underwater oil line rather than from a wellhead, little gas would issue of course, since the gas is separated from the oil before the oil is pumped into the line.

In the case of a drilling well, the drilling platform may be demolished either accidentally or purposely so that a mound of debris is strewn around the wellhead. The debris may project to a considerable height above the sea floor.

A number of containment devices are known. The containment devices are generally of two types. One style consists of a large diameter ring that floats on the water surface centered over the oil leak. Below the floating ring is suspended a barrier, usually circular, of flexible material that reaches from the surface to the sea floor around the oil leak. A toroidal or other-shaped anchor holds the barrier in place. Typical devices of the first type are exemplified by U.S. Pat. Nos. 3,653,215 to Crucet; 3,599,434 to Minaud; 3,548,605 to Paull et al, 3,879,951 to Mason; 3,469,402 to Lowd; and 4,047,390 to Boyce, II. In these devices the oil accumulates at the surface, is contained within the upper portion of the barrier and is thereafter pumped out to a storage vessel.

There are several objections to the above devices. First the lower part of the barrier must be anchored to the sea floor around the leak. Such action is difficult if not impossible in the presence of debris around the leak. Since the barrier walls are flexible, water currents, which may reach several knots, tend to distort and possibly displace the barrier walls. No provision is made to protect the device from heat if the gas becomes ignited. In most cases, the gas-saturated oil-water mixture is illustrated as being pumped out from above. Because of the high gas content, the pumps become inoperative because of vapor lock. Furthermore, in the presence of flared gas, the pumps and pipe lines and/or hoses are endangered.

Another style of oil containment device is in the form of an inverted cone or cup that is lowered over the oil leak at or near the sea floor. The leaking oil and gas is then pumped out through pipes or casing attached to the upper end of the inverted cup. These devices, too, must be anchored to the sea floor, something difficult to do in the presence of underwater obstructions. Some of the known devices provide a closed system including an oil/gas separator. However, if they must be deployed after the leak starts and the escaping gas is afire, it is very difficult and dangerous to safely move them into position through the hot gas flare.

Typical known devices of the inverted cup type are exemplified by U.S. Pat. Nos. 3,500,841 to Logan; 3,658,181 to Blair; 3,666,100 to Madij; 3,667,605 to Ziedlenski; and 3,745,773 to Cunningham.

It is the object of this invention to provide a barge-mounted oil-containment and recovery apparatus that can be safely towed into position over an oil leak in the presence of flaming gas at the surface of the water.

SUMMARY OF THE INVENTION

The oil-spill containment device comprises a floatation means such as a barge of desired dimensions. A well, open to the sea is provided at the center of the barge, extending vertically through the deck and keel and is open to the water. A cylindrical oil containment sleeve is suspended through the well to a desired depth beneath the barge over the oil leak to entrap ascending oil and gas therewithin. A fire wall is mounted inside the well, extending well above-deck. The bottom of the fire wall is set several feet below the water level in the well.

A standpipe, open to the fluid in the well in its upper end, extends downwardly, inside the hull of the barge, from just below the water line to the lowermost deck of the barge hull, terminating in a sump. A pump which pumps the accumulated oil to a storage vessel is connected to the bottom of the standpipe above the sump.

In an aspect of this invention, the upper end of the fire wall is inwardly tapered to form an open, burner-like mouth. When the escaping gas is ignited, depending on the volume of the escaping gas and the shape and height of the fire wall, the base of the flames may lie at or above the water level in the well.

In another aspect of this invention, the oil containment sleeve is constructed in several separate sections that may be of the telescoping type or the sections may be bolted together to form a single unit.

In another aspect of this invention, means are provided for igniting and flaring the escaping gas if it is not already burning when the barge is moved into position.

In an embodiment of this invention, a plurality of sprinkles is mounted on the deck. Water is pumped through the sprinklers to cool the deck around the flared gas inside the fire wall.

In another embodiment of this invention means are provided for retracting the oil containment sleeve from the well above the deck when the barge is underway. Guy cables are provided for securing the bottom of the sleeve in position with respect to the barge when the oil containment sleeve is lowered.

In a further aspect of this invention a conical shell is suspended beneath the lower end of the lowered oil containment sleeve at or above the sea floor whence the oil leak issues. The conical shell tends to compress the diffuse, upward oil flow into a more restricted cross section. For retraction, the conical shell may be retracted against the lower end of the oil containment sleeve. Thereafter the containment sleeve and the shell are retracted upwardly together as a unit to allow the barge to get underway.

In yet another aspect of this invention, baffles are provided inside the oil containment sleeve to reduce the vortical action of the oil flow.

In another embodiment of this invention means are provided for blanketing the oil, floating at the surface of the water in the well, with a flame-retarding agent such as foam or a liquid.

In yet another embodiment of this invention, the oil containment and recovery barge is split into two halves longitudinally. Each half-barge is moved into position and anchored on opposite sides of the source of leaking oil. Barrier curtains are stretched between the two half-barges and secured thereto by cables. The leaking oil is accumulated between the two half-barges and the flexible barrier curtains whence it is collected and transferred to storage.

BRIEF DESCRIPTION OF THE DRAWINGS

Other objects and advantages of this invention will be better understood by reference to the appended description and the accompanying drawings wherein:

FIG. 5 is a showing of an alternate embodiment of the oil containment and recovery barge assembly;

FIG. 6 is an alternate embodiment of the oil containment and recovery barge assembly employing telescoping sections for the containment sleeve;

DETAILED DESCRIPTION OF THE INVENTION

Figure 1:
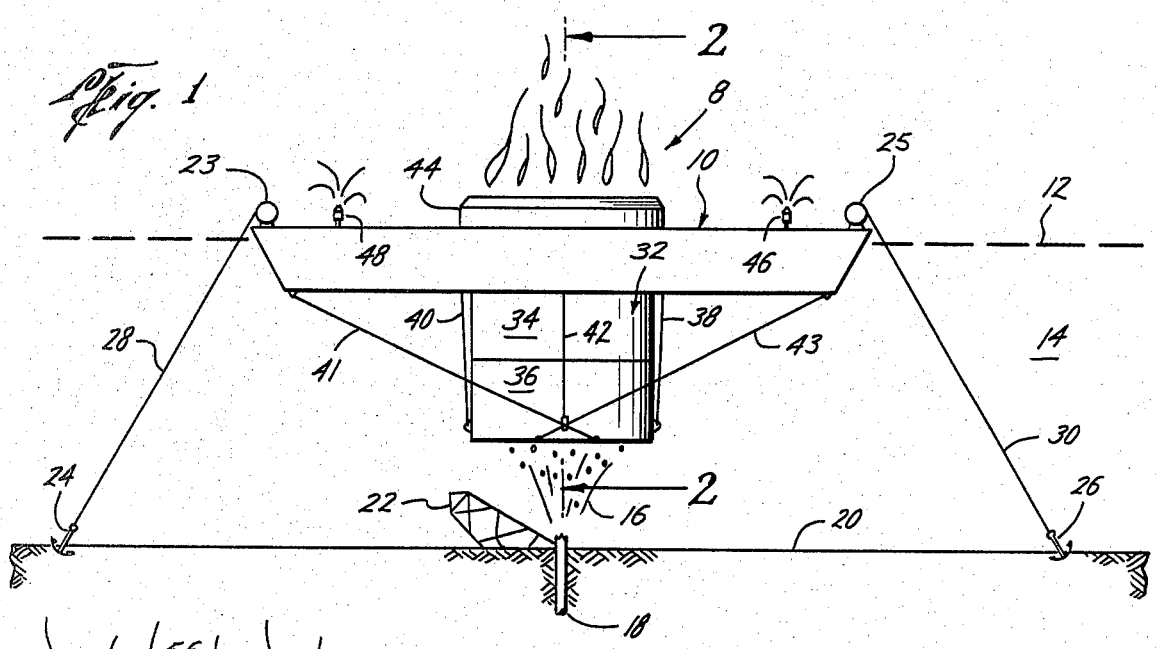
FIG. 1 is an overall view of the marine oil spill containment and recovery barge.

Referring to FIG. 1, there is shown an oil containment and recovery apparatus 8 floating at the surface 12 of a body of water 14. The apparatus is anchored over a plume of oil and gas 16 resulting from, for example, a ruptured casing 18 drilled into sea floor 20. The debris 22 from a demolished drilling structure obstructs direct access to the ruptured casing 18.

Apparatus 8 includes a floatation means 10 such as a barge which is held in position over the oil leak by anchors 24, 26 and anchor chains 28, 30 attached to anchor winches 23, 25. Two such anchors and winches are shown but at least four or more anchors may be used.

An oil containment sleeve 32, composed of two or more sections 34, 36 is lowered through a well (to be described in connection with FIG. 2) in the center of the barge 10 by cables 38, 40, 42. The containment sleeve may be of any shape but is preferably circular. The bottom end of the sleeve is secured by tension cables such as 41, 43.

A fire wall 44 lined with refractory material is removably mounted at the top of the well in a manner to be described. The gas-saturated water-oil mixture rises to the approximate ambient water level inside oil containment sleeve 32. The gas escapes into the fire wall into the open space above the water line. The gas may be intentionally flared to prevent poisoning the air surrounding the barge. A plurality of sprinklers such as 40, 48 continuously spray the barge deck to protect the deck against the heat of the flared gas.

Figure 2:
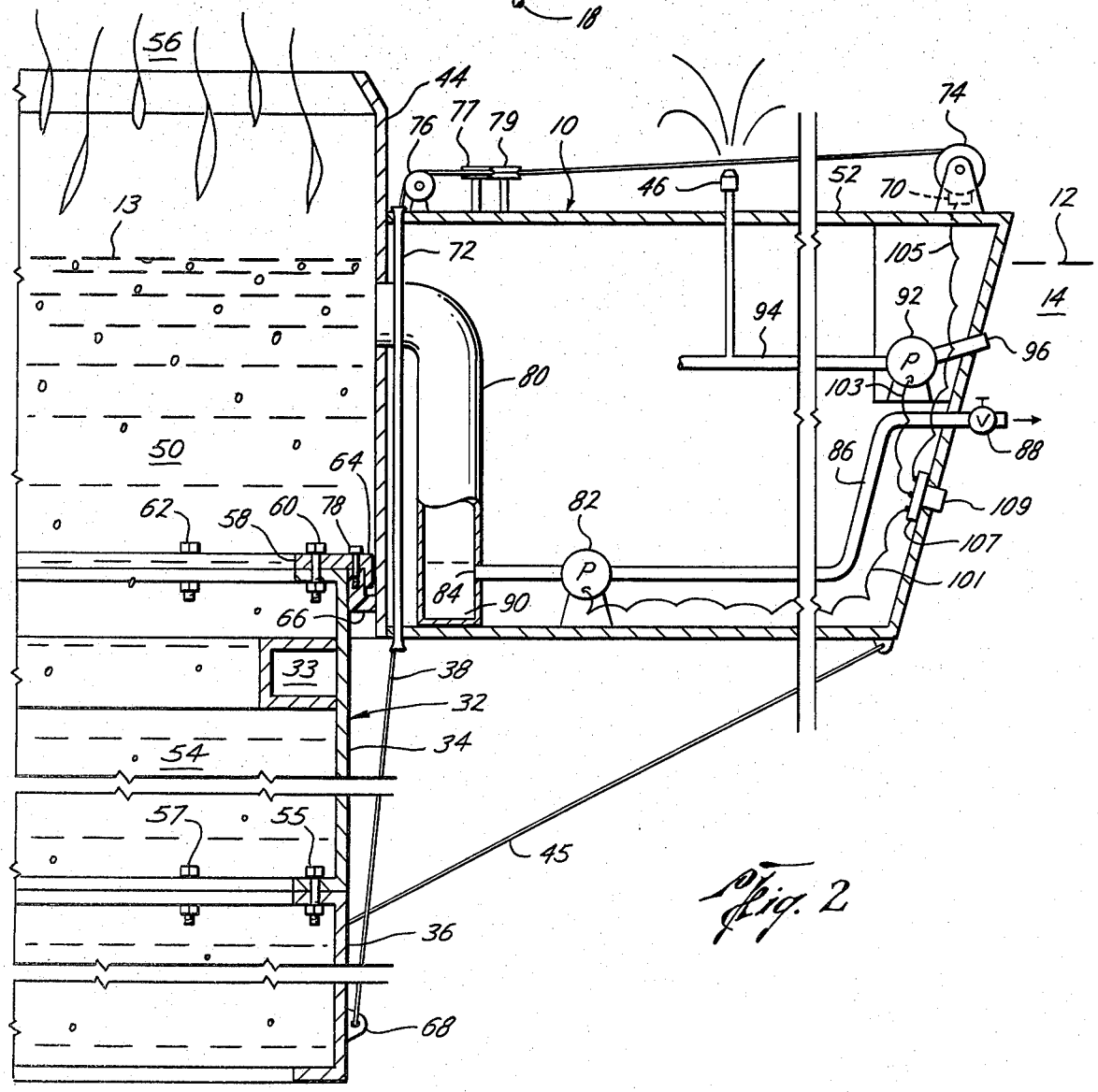
FIG. 2 is a cross sectional view of the right hand portion of the barge showing essential details.

FIG. 2 is a cross-section of barge 10 taken to the right of line 2–2'. Barge 10 includes a well 50, which is preferably circular and open to the water. Fire wall 44 is removably secured to the top of the well extending ten or more feet above upper deck 52. The gas saturated oil-water mixture 54 rises to a level 13 inside oil containment sleeve 32 that is the approximate ambient water level 12. The gas escapes from the mixture and accumulates inside fire wall 44 where it is ignited to form gas flare 56. The base of the gas flare may lie somewhere between the mouth of fire wall 44 and water level 13, depending upon the volume of the escaping gas and the shape and height of fire wall 44. Accordingly, the accumulated oil-water mixture will probably not become ignited. However, even if the oil does become ignited, the oil below the surface can be pumped out safely as it accumulates. It is an object of this invention to not only confine the leaking oil, but also to recover the oil and prevent it from burning. Accordingly, the floating oil may be blanketed by a layer of some well known flame-retardant agent such as a foam or a liquid to further protect the oil from ignition.

Oil containment sleeve 32, open at both ends, consists of two or more sections 34, 36 which may be bolted together as required such as by bolts 55, 57. Each section may be on the order of 25 to 30 feet long and 100 feet in diameter. An upper flange 58 is bolted to the top of section 34 by bolts such as 60, 62. Flange 58 has a lip 64 that fits over an L-shaped bracket 66 secured, as by welding, to the inner wall of well 50. When the containment sleeve 32 is fully lowered, lip 64 engages bracket 66, thereby holding the sleeve in place. A lower attachment lug 68 is welded to section 36. Preferably attachment lug 68 is semi-elliptical in outline as shown in order to prevent it from snagging the lower part of well 50 when the sleeve is retracted. A cable 38 is attached to lower attachment lug 68. Cable 38 passes inside the well 50 through a hollow riser 72, such as a 2" pipe, to a winch 74 over pulley 76. Riser 72 is secured as by welding to the wall of well 50 and passes between fire wall 44 and deck 52. By means of winch 74 and cables such as 38, oil containment sleeve 32 may be lowered or retracted during assembly and disassembly operations. Over the oil leak, the desired height of the sleeve above the sea floor can be adjusted by remote control of winches such as 74. In FIG. 2, only one winch is shown but in actual practice four or more such winches may be used. Once sleeve 32 has been lowered into position, the lower end is centered with respect to barge 10 by means of cables such as 41, 43 (FIGS. 1 and 2), to be more fully discussed with reference to FIG. 4. The upper flange is secured to bracket 66 by means of a plurality of studs such as 78.

To reduce the weight in water of the fully-assembled oil containment sleeve 32, a sealed buoyancy chamber such as 33 may be installed inside one or more of the sections such as 34 or 36.

A standpipe 80 is installed inside barge 10. A low pressure, high volume pump 82, having a inlet 84 connected to standpipe 80 near the bottom hull of the barge withdraws the oil-water mixture that accumulates inside standpipe 80. The fluid is discharged through pipe line 86 to an underwatere discharge valve 88 to which a submerged transfer hose may be connected by divers. The effluent is pumped into a remotely-located tank ship (not shown in FIG. 2). The transfer hose is kept submerged in the vincinity of the barge so that if gas should escape around the confines of the barge and become ignited, the transfer hose will not be endangered.

The mouth of standpipe 80 is, of course, below the water level 13 inside well 50 which may be higher than the ambient water level because the accumulated oil is lighter than uncontaminated water. The diameter of standpipe 80 is rather large, on the order of five feet, so that most of the entrained gas bubbles can escape before the fluid enters pump 82. Because the pump is located at the bottom of the barge hull, there will exist a hydrostatic head of 15 to 25 feet which will tend to hold small amounts if dissolved gas in solution before reaching the pump. The standpipe furthermore provides a protected volume whence most of the gas bubbles can dissipate upwards from the oil/water mixture. Accordingly vapor lock should not occur. The region, 90, below pump inlet 84 of standpipe 80 acts as a sump to entrap particulate matter.

A single standpipe-pump unit is illustrated in FIG. 2. Several such units may be installed as required so that the total pump capacity exceeds the volume of flow of the leaking oil.

A plurality of sprinklers such as 46 are installed on the barge deck to protect the deck from the heat of the gas flare by emiting an upwardly-directed water curtain around the fire wall and well. The sprinklers are supplied with water by pump 92 installed below-deck. As will be shown in FIG. 3, the sprinklers are connected to a suitable network of piping 94. The inlet 96 of pump 92 is well below water line 12 to insure a positive water supply. The inlet slopes upwards so that any gas in the water around the barge will not become entrapped.

Figure 3:
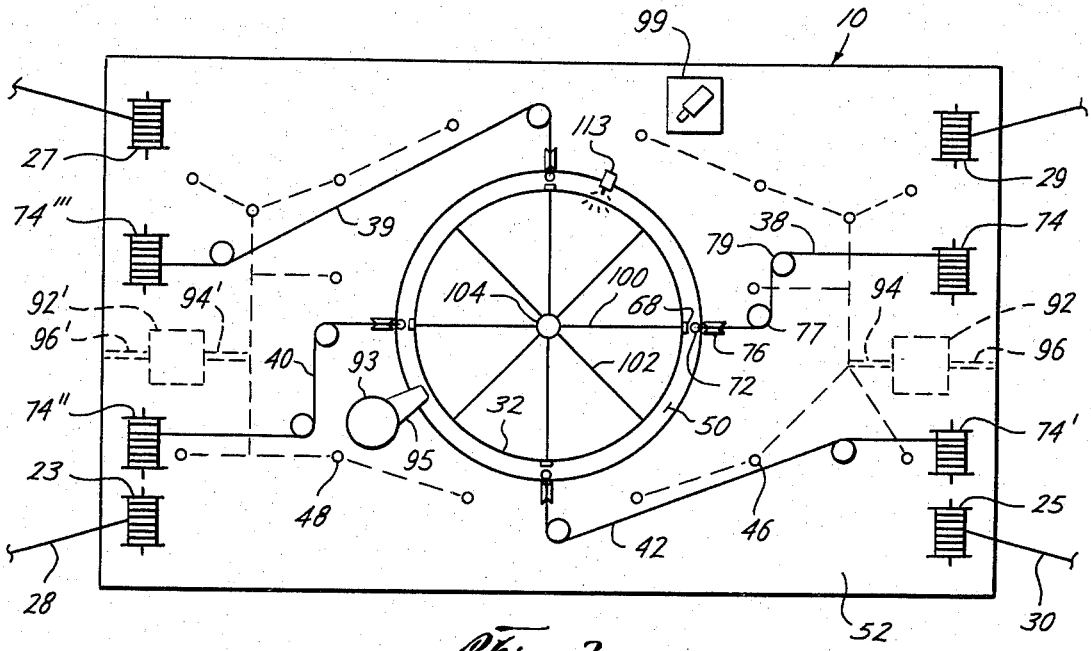
FIG. 3 is a top view of the barge showing the arrangement of the winches and the outlines of the below-decks sprinkler plumbing.

FIG. 3 is a top view of the upper deck of barge 10. The barge is on the order of 175×300 feet with a depth of 30 feet. The well 50 is preferably 100 feet in diameter. The pattern of below-deck plumbing 94, 94′ and pumps 92, 92′ are shown by means of dashed lines. A preferred distribution of the above-deck sprinklers such as 46, 48 is symbolized by the small circles. Four anchor winches 23, 25, 27, 29 are shown at the four corners of barge 10. The anchor winches may be remotely controlled from a mother ship.

A container 93, holding a quantity of fire-retardant agent such as foam or liquid is mounted on deck 52 of barge 10. A discharge nozzle 95 directs the foam at the oil/water surface inside well 50. For simplicity, only one container is shown but many more could be employed if desired.

Winches 74, 74′, 74″, 74‴ that handle cables 38, 40, 42 as well as a fourth cable 39, not previously shown, are mounted on deck 52 at the extreme ends of the barge next to the anchor winches. The winches are located as far as possible from well 50 to protect them against heat. Additional fire screens, not shown, may be erected as desired. As previously discussed, these winches are used to lower or retract oil containment sleeve 32. Four such winches are shown but more could be used in accordance with the total weight of assembled sleeve 32. A system of sheaves such as 76, 77, 79 route the cables across the deck of barge 10 to their appropriate winches.

It is necessary that the shaft rotation of the winches be synchronized accurately. If synchronization were not provided, oil containment sleeve 32 could become skewed along its vertical axis during lowering or retraction. An axial skew would cause sleeve 32 to jam inside well 50. Accordingly, each winch is provided with a remote-reading shaft rotation counter 70 (FIG. 2) so that an operator can maintain an evenly-distributed lifting force. Additionally, displacement sensors (not shown) are mounted vertically along the sleeve 32 between the sleeve and the wall of well 50 to sense accurately, the vertical sleeve displacement. A set of sensors is associated with each sleeve-lifting cable. In combination with suitable servo devices associated with the rotation counter 70, the displacement sensors will compensate for differential cable stretch, uneven cable lays on the winch drum, etc.

Preferably all equipment is electrically powered by spark-proof motors. Electrical power is furnished through submarine cables 97 from a mother ship 156, FIG. 8. Suitable control-signal cables 154 may be provided so that all equipment aboard the barge may be operated and monitored by remote control from the mother ship 156. One or more suitably heat-protected TV monitors such as 99 are mounted on the deck 52 of barge 10 so that a close-up view of activities aboard the barge can be viewed by an operator on a mother ship such as 156, FIG. 8.

Referring back to FIG. 2, electrical power and control cables such as 101, 103, 105 from pumps 82 and 96 and from winch 74, are terminated at a junction box 107, mounted inside the hull of barge 10. An underwater connector receptacle 109 is provided outside the hull so that divers can make an electrical connection with a mother ship 156, FIG. 8.

Each section 34, 36 (FIGS. 1 and 2) of oil containment sleeve 32 is rigidly braced in tension by a plurality of tie rods or cables such as 100, 102. Eight such tie rods or cables are shown, but more may be used if required. Each tie rod or cable is coupled at one end to a central ring 104 and at the other end, to the wall of the appropriate oil containment sleeve section such as 34 and 36. When tightened, the plurality of tie rods or cables hold the sleeve in its proper cylindrical shape in the same manner as spokes on a bicycle wheel. The tie rods or cables may be removed after sleeve 32 is in place, if such removal is preferred.

Figure 4:
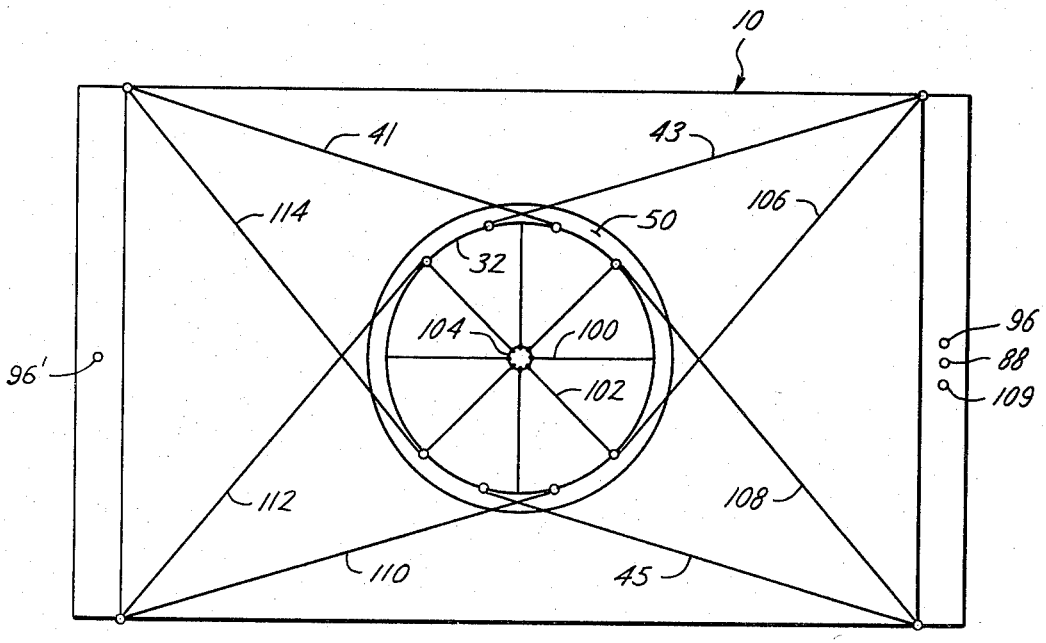
FIG. 4 is a bottom view showing the cable tensioning system for holding the containment sleeve in place.

FIG. 4 is a view of the barge looking from below. The lower end of oil containment sleeve 32 is held in place by tension cables 43–45 and 106–114. The ends of each pair of cables are fastened to the corners of barge 10. The other ends of each pair of cables are secured to the lower end of oil containment sleeve 32.

In one embodiment of this invention, instead of radial tie rods or cables as shown in FIGS. 3 and 4, radial baffles, extending axially along the length of the section may be used. The baffles divide the interior of oil containment sleeve 32 into eight vertical pie-shaped cells. The purpose of the vertical cells is to allow free upward flow of the oil plume but they break up the vortices to provide more nearly laminar flow and to provide better gas separation from the oil-water mixture.

FIG. 5 shows a different embodiment of this invention. In addition to oil containment sleeve 32, there is provided a conical flow director 116. Flow director 116 is open ended at top and bottom and has an upper opening 118 whose diameter is less than lower opening 120. A lip 122 is secured to the lower opening 120. The outer diameter of lip 122 is such that when flow director 116 is raised as by cables 38, 40, 42, the lip 122 engages the bottom end 124 of sleeve 32, thereafter to retract both flow director 116 and sleeve 32. The purpose of flow director 116 is to capture a widely dispersed oil/gas plume 16, restrict the plume to a lesser diameter and direct the plume into containment sleeve 32. Flow director 116 is centered with respect to barge 10 by tension cables such as 47, 49. Flow director 116 may also be anchored to the sea floor by anchor lines such as 124, 126.

Referring now to FIG. 6 in another embodiment of this invention, oil containment sleeve 32 may be constructed of telescoping sections 130, 132, 134 shown schematically in the figure. When not is use, the telescoping sections are raised into well 50 of barge 10 by cables such as 38, 40. Such an arrangement avoids the need for bolting each section together as shown in the previous figures. Of course, the bottom end of the bottom section may be held centered with respect to barge 10 by tension cables as was shown in FIG. 4 and other figures.

Figure 7:
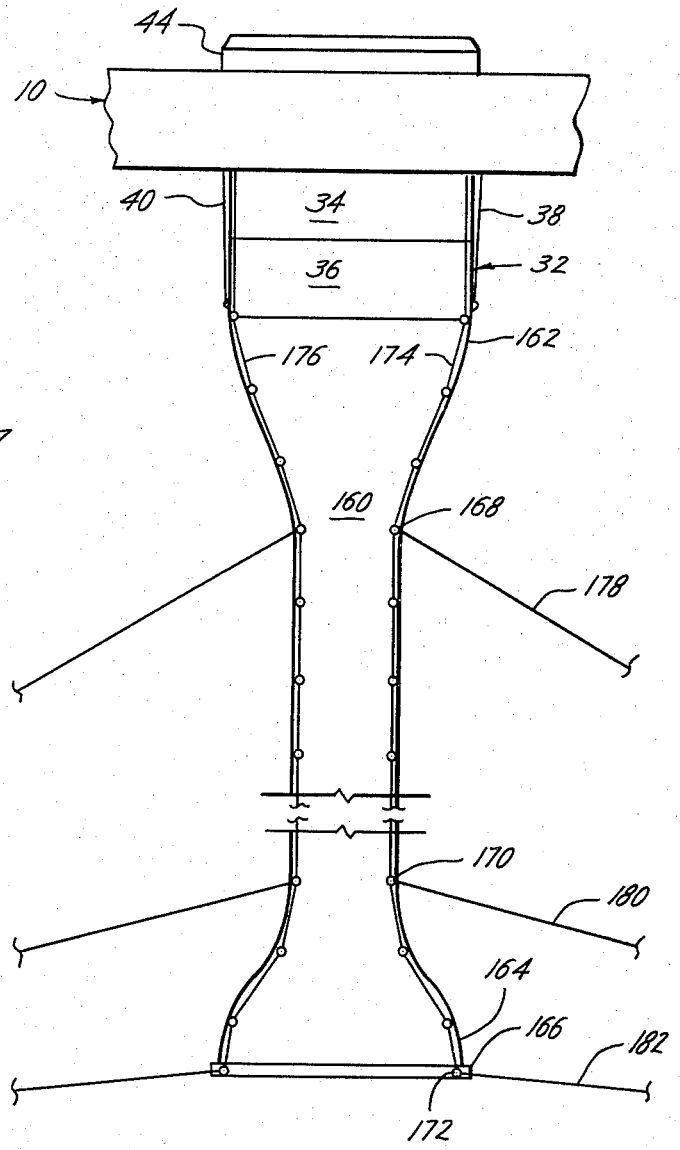
FIG. 7 is another embodiment of the oil containment and recovery assembly employing an elongated, reduced-cross-section sleeve for use in deep water.

FIG. 7 shows another alternate embodiment of this invention for use primarily with oil leaks in very deep water in the range of 500–1000 feet. A rigid oil containment sleeve of sheet steel as long as 1000 feet is too heavy to be practical. Accordingly an elongated flexible barrier 160 of plastic impregnated fabric is secured to the lower end of oil containment sleeve 32. The flexible barrier 160 has a substantially reduced cross section for most of its length in order to reduce the area exposed to ocean currents. The barrier is flared at the top end 162 for connection to oil containment sleeve 32. The bottom end, 164 may also be flared and secured to a means 166, such as a metal ring, for anchoring the lower end at or near the sea floor over the oil leak. Barrier 160 may be of an accordion-like, pleated structure. A plurality of rings such as 168, 170, 172 are fastened to the outside of barrier 160. Cables 174, 176 threaded through the rings and attached to winches (not shown) on the deck of barge 10, provide means for lowering or gathering up barrier 160. Two such cables are shown but many more are used in practice. A plurality of anchor lines such as 178, 180, 182 are provided to hold barrier 160 in place in the face of strong currents.

Figure 8:
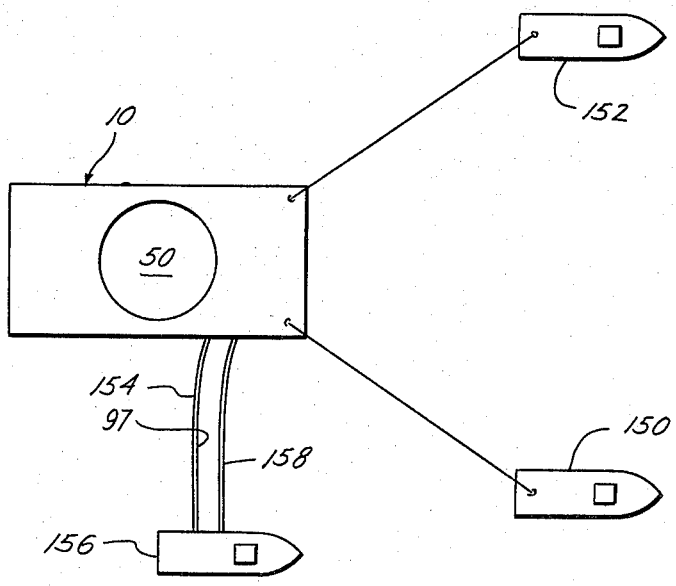
FIG. 8 shows the barge being towed into position over an oil leak.

In operation, barge 10, FIG. 8 is towed by tugs 150, 152 close to the site of the oil leak. While the barge is underway during towing, of course, all or part of the oil containment sleeve sections 34, 36 are stored inside well 50. The remainder of the sleeve sections as well as fire wall 44 may be stowed on deck or on another barge or ship. In the operating area, but temporarily clear of the oil leak, the barge is connected to a source of electrical power by suitable cables 97 from a mother ship 156 through receptacle 109. The sections are lowered into place in well 50 by lifting cables 38, 40, 42 and bolted together. After upper flange 58 is bolted to the assembled oil containment sleeve, the entire assembly is lowered into the water so that lip 64 engages bracket 66. The tension cables 41–45, 106–114 are secured to the lower part of the sleeve 32. Fire wall 44 is now moved into place and suitably secured. Of course, if underwater obstructions are expected to lie in the path of the barge, the oil containment sleeve may be rigged and then raised ten or fifteen feet until the barge is on site. There, the sleeve is lowered back in place.

After assembly, the sprinklers are turned on and the barge is towed into place over the oil leak by tugs 150, 152. It is immaterial if the leaking gas is already afire. The barge can be towed into place through the gas flare. If the towing action extinguishes the gas flare, it is preferably to re-ignite the gas to avoid dissemination of noxious gases. Re-ignition could be accomplished by means of a specially-designed spark plug such as 113, FIG. 3 in combination with a conventional high-voltage transformer.

Once in place and anchored, submerged transfer hoses 158 may be deployed from a waiting oil-storage, mother ship 156 and connected to oil discharge valves such as 88 by divers. Pump 82 then draws the accumulated oil-water mixture from well 50 and discharges it into the waiting storage ship such as 156. Alternatively, the oil transfer hoses 158 may be connected to the oil storage ship before moving barge 10 into position to avoid endangering divers. Although the storage ship is shown as a mother ship, the storage vessels may be separate barges that can be towed away when filled, leaving the mother ship on location.

Once on location, all operations are conducted by remote control from the mother ship 156. Details of equipment operation are telemetered to an operator over telemeter and control lines 154. TV Camera 99 provides visual monitoring. Since the anchor winches are also remotely controllable, the barge may be maneuvered over a limited area without use of tugs.

The advantage of this invention is that the oil containment barge can be completely rigged in safety outside the immediate area of the oil leak. When all is ready, the barge is towed into position for operation.

The height above the sea bottom of the base of the oil containment sleeve is adjustable so that the assembly can be maneuvered without danger of snagging. In the event however that the oil containment sleeve 32 should accidentally be damaged so that it cannot be retracted, the sleeve assembly 32 can be released from upper flange 58. Thereafter it can be lowered away from the barge hull and recovered by an auxiliary ship. Such disassembly would, of course, be done after the barge is towed a safe distance away from the oil leak.

On location, the sleeve 32 which may extend up to one hundred or more feet beneath the barge, acts as a keel to minimize pitch and roll of the barge in heavy seas.

In the embodiment of FIG. 6, the telescoping sections 130, 132, 134 of sleeve 32 are retracted up inside well 50 of barge 10 for transportation. At or near the site of operations, they are lowered into place.

All of the previously-discussed embodiments are intended for use over relatively confined oil leaks where the oil containment and recovery barge can be towed in one unit over the oil/gas leak. A somewhat different situation exists in the presence of a surface obstruction such as a wrecked oil tanker or a burning oil well where the drilling platform is still intact. In an alternate embodiment of this invention, the oil containment and recovery barge is split in half longitudinally. The two half-barges are anchored and tied together around or over the leak and obstruction if present, or at opposite ends of the leaking structure if it covers a large hole. A flexible barrier curtain is stretched between the two half-barges and secured thereto to contain the leaking oil. Oil skimmers of any known type may then be used if necessary to direct the leaking oil towards the standpipes for collection and storage.

Figure 9:
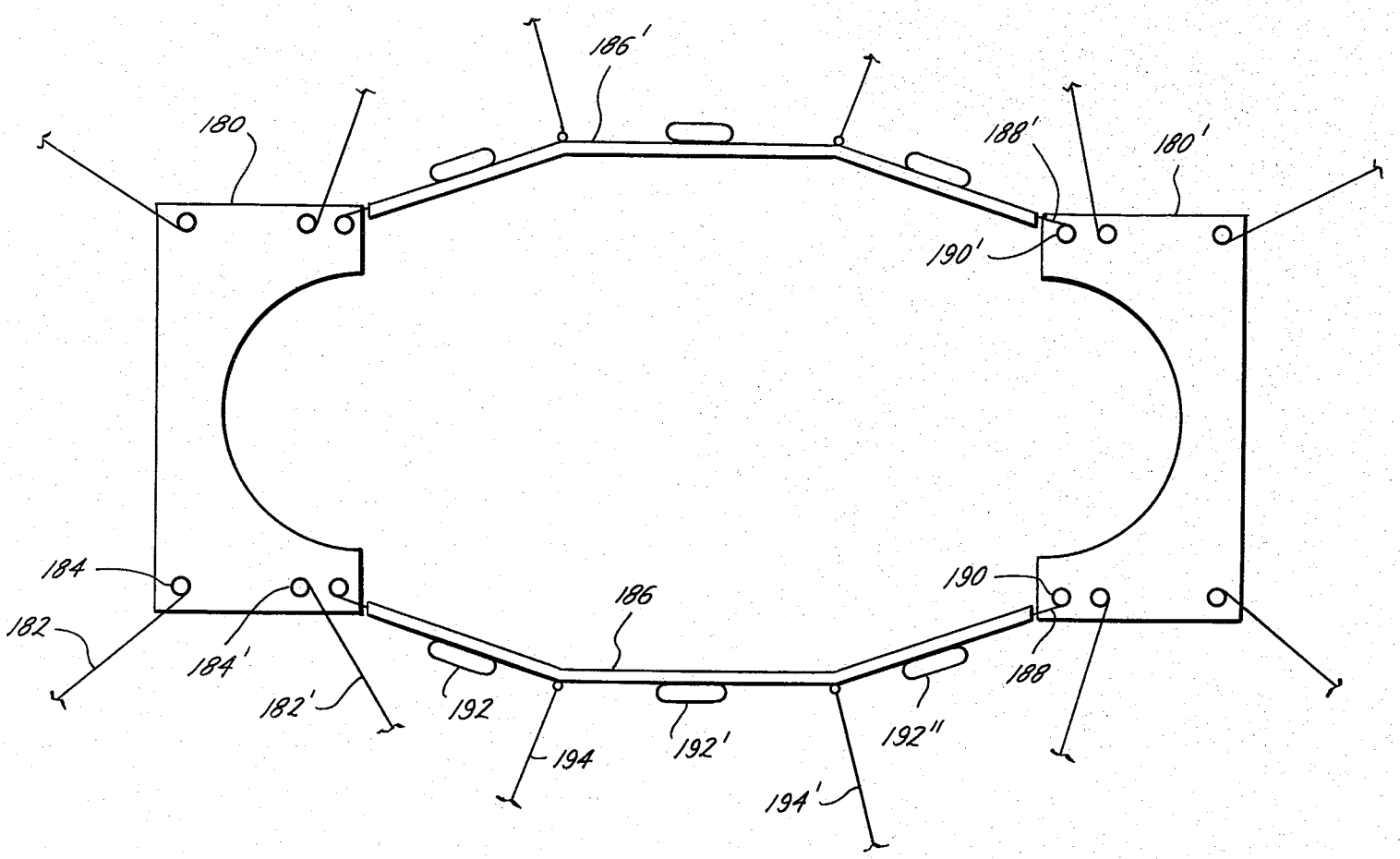
FIG. 9 is an alternate embodiment of this invention.

Referring to FIG. 9, each half-barge 180, 180' is rectangular with a semicircular cutout in the center. The length of a half-barge such as 180 is preferably 300 feet and the beam at the widest points is 150 feet. The radius of the semicircular cutout is 100 feet, twice the radius of the well in the barge 10 of FIG. 3. The increased radius is required by reason of the large dimensions of a tanker or offshore drilling platform. Each half-barge such as 180 is anchored in place by a desired number of anchor lines such as 182, 182' and similarly for half-barge 180'. Each anchor line is handled, of course, by an anchor winch such as 184, 184', half-barge 180.

Flexible barrier curtains such as 186, 186' are supported by cables 188, 188' secured to half-barges 180, 180' as by winches 190, 190'. Additional support is furnished by floats such as 192, 192', 192'' that are attached to the barrier curtains such as 186. The depth of the barrier curtains is approximately equal to the draught of the half-barges or 20–25 feet. The barrier curtains may be held in an expanded position, as shown, by anchor lines such as 194, 194'.

Half-barges 180, 180' are provided with all of the accessory equipment as shown in FIGS. 2 and 3, including anchor winches, pumps, sprinklers, standpipes, etc., but they do not include slidable oil containment sleeve 32 and its attendent winches nor do they necessarily include fire wall 44. As previously described, all of the equipment aboard each half-barge is operated by remote control from one or more mother ships (not shown).

It will be appreciated that the embodiment of the oil containment and recovery apparatus just described encompasses a relatively large area. Accordingly, the depth of the accumulated oil will not be very great as the oil scum is dispersed over a wide area. Accordingly the bottom of the inlet opening of a standpipe such as 80, FIG. 2, is adjustable in height relative to the oil-water interface. The lower portion of the inlet opening should be slightly below the interface so that a maximum amount of oil is collected relative to the amount of water that must be ingested by pump 82. The simplest method of height adjustment is to charge the draught of the half-barges 180, 180' by adding or removing ballast.

Because of the relatively large area encompassed by half-barges 180, 180' and barrier curtains 186, 186', it is preferable to employ skimmers of any well-known type to urge the oil towards the intakes of the standpipes in the two barges.

I claim as my invention:

1. An oil leak containment and recovery apparatus for use in water-covered areas comprising:

a floatation means having a deck and a well therethrough open to the water, the water in the well rising to a prescribed level;

a hollow oil containment sleeve, having a wall, open at its upper and lower ends, slidably mounted in said well;

means for lowering said oil containment sleeve through the well into the water beneath the floatation means when in use and for retracting said sleeve when underway;

means for anchoring said floatation means over an oil/gas leak so that an upward flow of said oil and gas becomes entrapped at the upper end of said sleeve; and means for removing the entrapped oil to storage.

2. The oil containment and recovery apparatus as defined in claim 1 further comprising:

means for igniting and flaring the gas that accumulates with the entrapped oil.

3. The oil containment and recovery apparatus as defined in claim 2 further comprising:

means for forming an upwardly-directed water curtain surrounding said oil containment sleeve to protect the deck of said floatation means from the heat of said flared gas.

4. The oil containment and recovery apparatus according to claim 3 comprising:

an oil containment sleeve formed from a plurality of telescoping sections, the lower section having a predetermined diameter with respect to the upper section.

5. The oil containment and recovery apparatus according to claim 3 further comprising:

a hollow oil-flow director open at its upper and lower ends and having tapered walls, the dimensions of the upper end being less than the dimensions of the lower end;

means for suspending said flow director at a desired depth below the lower end of said oil containment sleeve when in use and means for retracting said flow director into said oil containment sleeve when said barge is underway.

6. The oil containment and recovery apparatus according to claim 5 comprising:

a lip mounted on the lower end of said oil-flow director so that when said oil flow director is retracted, the lip engages the lower end of the oil containment sleeve and retracts said oil containment sleeve through said well.

7. The oil containment and recovery apparatus according to claim 5 comprising:

means for anchoring said suspended oil-flow director over said oil/gas leak independently of the anchoring means associated with said flotation means, to positively direct the upward oil/gas flow into said oil containment sleeve and to minimize lateral dispersion of said flow.

8. The oil containment and recovery apparatus according to claim 3 comprising:

tensioning means for rigidly securing at least the lower end of said sleeve to said floatation means when said sleeve is in the lowered position so that said lowered oil containment sleeve acts as a keel to damp pitching motions of said floatation means.

9. The oil containment and recovery apparatus according to claim 3 comprising:

a bouyancy means secured to the inner wall of said oil containment sleeve.

10. The oil containment and recovery apparatus according to claim 3 comprising:

means, extending upwardly from the deck of said floatation means, for containing and flaring escaping gas.

11. The oil containment and recovery apparatus according to claim 10 wherein said means for lowering and retracting said oil containment sleeve comprises:

a plurality of sleeve-lifting winches;

a plurality of cables each having two ends, each said cable being attached at one end to the lower end of said oil containment sleeve and at the other end to a one of said sleeve-lifting winches; and means for equalizing the lifting forces of said winches.

12. The oil containment and recovery apparatus according to claim 3 wherein said entrapped oil removing means comprises:

at least one standpipe extending from just beneath the water level in said well to the bottom hull of said floatation means; and a pump having an inlet coupled to said standpipe at a point near the bottom hull of said floatation means, the outlet of the pump being coupled to a submerged discharge valve.

13. The oil containment and recovery apparatus according to claim 10 comprising:

means for applying a blanket of a flame-retardant agent over the surface of the fluid inside said well.

14. The oil containment and recovery apparatus according to claim 11 comprising:

means for remotely controlling from a mother ship the operation of said sleeve-lifting winches, said water-curtain forming means and said pumps; and means for remotely monitoring, at said mother ship the functioning thereof.

15. The oil-containment and recovery apparatus according to claim 14 comprising:

a plurality of remotely controllable anchor winches mounted on the deck of said floatation means.

16. The oil containment and recovery apparatus according to claim 15 comprising:

an elongated flexible barrier of reduced cross section secured to the lower end of said oil containment sleeve.

* * * * *